United States Patent [19]

Wechter

[11] 4,090,341

[45] May 23, 1978

[54] TREATMENT AND PACKAGING OF GAS HANDLING EQUIPMENT

[75] Inventor: Stephen George Wechter, Palmyra, N.J.

[73] Assignee: Airco, Inc., Montvale, N.J.

[21] Appl. No.: 814,598

[22] Filed: Jul. 11, 1977

[51] Int. Cl.[2] ..... B65B 31/00; B65B 55/00

[52] U.S. Cl. ..... 53/21 R; 53/22 R; 53/25

[58] Field of Search ..... 53/6, 7, 21 R, 22 R, 53/22 B, 25

[56] References Cited

U.S. PATENT DOCUMENTS

| | | | |
|---|---|---|---|
| 2,426,663 | 9/1947 | Bevins | 53/25 X |
| 2,814,382 | 11/1957 | Lassiter | 53/21 R X |

*Primary Examiner*—Travis S. McGehee

*Attorney, Agent, or Firm*—David L. Rae; L. R. Cassett; E. W. Bopp

[57] ABSTRACT

A method of treatment of equipment used in critical gas handling applications includes flowing designated gases through the equipment and packaging the equipment in an inert atmosphere for shipment.

9 Claims, No Drawings

TREATMENT AND PACKAGING OF GAS HANDLING EQUIPMENT

FIELD OF THE INVENTION

The present invention relates to the treatment of gas handling equipment so as to remove contaminants therefrom and reduce or eliminate absorption of gases into the material of which the equipment is constructed during use of such equipment.

BACKGROUND OF THE INVENTION

It is well known that there are certain gases which are absorbed into the surface of certain metals. These metals each have a characteristic maximum absorption level, which having once been reached through sufficient exposure to a given gas, remains unchanged unless the equipment is exposed to certain other media, for example, air or water vapor.

This characteristic of absorption can be troublesome, especially in certain delicate applications; for example, in the field of monitoring ambient air. These tests are usually carried out on automatic machines which must be calibrated by flowing a sample gas therethrough and adjustment of the machine such that the readings produced by the sample gas match the known concentrations of the sample gas constituents. In order to assure accurate calibration, the constituents of the sample gas must remain in the same concentration after passage through gas handling equipment as measured by the laboratory which produced it, so that the concentrations measured on a previously-calibrated instrument are in fact the same as those to be detected by the machine to be calibrated. Furthermore, gas handling equipment generally carries contaminants such as residual moisture or oils on surfaces thereof and such contaminants may react with and thus alter the relative concentrations of constituents of sample gases.

It is therefore necessary to insure that the gas handling equipment used to convey the sample gas from the container in which it is shipped into the machine to be calibrated does not interact with the gas and alter the relative concentration of its constituents. Clearly, the same difficulty must be dealt with in all situations where the composition of a gas is critical, whether for calibrative, chemical, anesthetic, industrial or other purposes.

OBJECTS OF THE INVENTION

It is therefore an object of the invention to provide gas handling equipment which will not interact with the gases with which it is used.

Another object of the invention is to reduce the time required to calibrate gas and analysis equipment, with a concomitant reduction in the loss of sample gas during calibration or "start-up" of such equipment.

It is a further object of the invention to provide a method for substantially precluding the interaction of gases with metal surfaces of gas handling equipment during use of such equipment.

Still a further object of the invention is to provide a method whereby contamination, dilution and changes in relative concentrations of gases or gas mixtures during passage through gas handling equipment can be eliminated.

Other aspects and uses of the invention will be apparent to those skilled in the art.

SUMMARY OF THE INVENTION

The present invention provides a method which satisfies the need felt in the gas-handling art for an equipment treatment process which will prevent the equipment from interaction with the gases during usage of such equipment with such gases by flowing the gas or gas mixture with which it is to be used through the equipment and then packaging such equipment in a sealed container in the same or an inert gas. In this manner the metal surfaces of the equipment exposed in use to absorbent gases are brought into equilibrium with such gases and such surfaces will not change the concentrations of the gas or gas mixtures with which the surfaces come into contact. Furthermore, upon flowing such gas or gas mixtures, contaminants on surfaces exposed to the flowing gas will react therewith and be removed prior to packaging of the gas handling equipment.

DESCRIPTION OF THE PREFERRED EMBODIMENTS

In the specific example of an ambient air analyzer described above, the gases of interest are typically $SO_2$, $H_2S$, CO, $CH_3SH$, $CS_2$, NO, and $NO_2$. Carefully tested mixtures of these gases in synthetic air, nitrogen or hydrocarbon base are commercially available for calibration purposes. It will be understood that synthetic air is formed by mixing pure nitrogen, pure oxygen and carbon dioxide in the relative proportions that such gases exist in ambient air thereby resulting in a highly pure but "synthetic air" mixture. These gases ($SO_2H_2S$, etc.) are all absorbed at characteristic rates into the metal surfaces of the regulators, valves, lines and other fittings of the analyzer or machine, and as described above, it is therefore essential that all parts of the machine in contact with such gases be pre-flowed before either calibration or testing to assure that the relative concentrations of gases making up the calibration gas mixture to be tested is not disturbed.

The method according to the invention provides for pre-treatment of the gas handling equipment, such as regulators, used to pass or dispense calibration gases (i.e. gases of known composition). These regulators are pre-flowed with or exposed to gas mixtures containing relatively high concentrations of the gases with which they are to be used and are packaged in the same gas, or in nitrogen or another inert gas. The user of the regulators is then only required to purge the pretreated gas handling equipment, thereby reducing the "start-up" time (i.e. the time required to calibrate a machine, etc.) from, typically, 24 hours to less than 30 minutes. This savings of time is an obvious advantage to the user. Moreover, the method of the invention further allows the user to avoid wastage of considerable quantities of sample calibration gas, inasmuch as if the user were to use calibration gas for pre-flowing purposes, its utility as a fixed standard would necessarily be destroyed due to absorption of calibration gas constituents into metal surfaces of the gas handling equipment. When the method of the invention is utilized, the user need only pass enough calibration gas through the gas handling equipment to be certain that all packaging gas has been flushed out.

A typical calibration gas will have the composition:

CO: 0.05–100 ppm.

$SO_2$: 0.05–100 ppm.

NO: 0.05–100 ppm.

$NO_2$: 0.05–100 ppm.
$H_2S$: 0.05–100 ppm.
COS: 0.05–100 ppm.
$CS_2$: 0.05–100 ppm.
$CH_3SH$: 0.05–100 ppm.
$N_2$: Balance A user might typically find that pre-treatment of gas handling equipment, i.e. regulators, fittings, etc. with the above calibration gas would require about 24 hours and the waste of considerable quantities of the calibration gas. If the equipment is pre-flowed by the method of the invention, the time required for contaminants, such as moisture and traces of oil on surfaces exposed to such gases, to be removed and for such constituent gases to be absorbed by the metallic surfaces of such equipment can be reduced significantly. It has also been found that the treatment process of the invention can be accelerated by heating the equipment to roughly 150° F during the process; furthermore, if the equipment is thus preheated, the presence of moisture will be eliminated.

The composition of the gas mixture used to pre-flow the equipment is not critical, but preferably the gases of significance are present in relatively high concentrations, e.g. 100 ppm. With such a mixture, it is found that preflowing the treatment mixture through the warmed equipment for roughly 30 minutes, then trapping the treatment mixture within the equipment for approximately 2½ hours is sufficient to react with surface contaminants and to reach the maximum absorption level of treatment mixture constituents in the metal surfaces of the equipment. The equipment may then be purged with a non-reactive gas, e.g. nitrogen, and packaged in this purging gas for shipment. Alternatively, the equipment can be shipped in the treatment gas. It was found that a typical reduction in start-up time is from approximately 25 hours (the time taken for a new stainless steel regulator to stabilize) to less than 20 minutes, when a similar regulator is treated using the process of the invention. Accordingly, a user of such a regulator has considerably greater access to its use and does not waste large quantities of expensive gas mixtures, e.g. calibration gases, during stabilization of this item of gas handling equipment.

An alternative to pre-flowing equipment intended for use in sensitive applications is useful where some change in the composition of the gases is permissible. In such cases the equipment can simply be pre-flowed and packaged in a non-reactive gas (i.e. one which will not affect the absorbed gas in the metal), typically nitrogen. It will be apparent to those skilled in the art that a certain amount of absorption of gas into the surfaces in contact therewith can then be expected; however, the pre-flowing nevertheless has the effect of cleansing and purifying the equipment as mentioned above, so that the user can be certain that there are no impure gases trapped within the equipment.

It is thus shown how it is possible to prepare gas handling equipment of all types so as to prevent contamination or alteration of relative proportions of gas mixtures. It will be apparent that there are numerous modifications which can be made to the method of the invention which fall within the spirit and scope of the following claims.

I claim:

1. A method of treatment of gas handling equipment intended for use with a specific gas mixture wherein said equipment includes metal surfaces exposed to said gas mixture and which comprises exposing the equipment to a gas mixture having greater concentrations of selected constituents of said specific gas mixture for a period of between two and forty-eight hours, so that an equilibrium absorption level of said constituents will be established in said metal surfaces exposed to said gas mixture, and packaging the equipment in an atmosphere of a gas which will not disturb said absorption level.

2. The method of claim 1 in which said equipment is packaged with a gas mixture similar to that with which it is to be used.

3. The method of claim 1 in which the gas mixture to which the equipment is exposed contains concentrations of at least one hundred parts per million of each of the said selected constituents.

4. The method of claim 1 in which said equipment, having been thus treated, is packaged in a non-reactive gas.

5. The method of claim 4 in which said non-reactive gas is nitrogen.

6. The method of claim 1 in which said equipment it heated to between 100°–200° F throughout its exposure to the gas mixture.

7. A method of treatment of gas handling equipment having metal surfaces exposed intended for use with specific gas mixtures which comprises:

heating the equipment to a temperature between 100°–200° F;

flowing a gas mixture of similar composition but of higher concentration of selected constituents through the equipment and for a period of at least 20 minutes.

trapping a quantity of the similar gas within the equipment and for a period of at least 2 hours such that at least a portion of said gas is absorbed in surfaces of said equipment exposed to said gas and contaminants on said surfaces are substantially reacted with said gas mixture;

purging the equipment with an inert gas; and packaging the equipment in a sealed container containing said inert gas.

8. The method as defined in claim 7 wherein the step of flowing a gas mixture through said equipment comprises passing through said equipment a gas mixture comprised of at least each of the following constituents:

100 ppm. NO
100 ppm. $SO_2$
100 ppm. $NO_2$
100 ppm. $H_2S$
100 ppm. COS
100 ppm. $CH_3SH$
100 ppm. $CS_2$
100 ppm. CO the balance of said gas mixture selected from the class of nitrogen or synthetic air.

9. The method as defined in claim 8 wherein said gas handling equipment comprises one or more regulators and said specific gas mixture comprises a calibration gas having the following composition:

0.05–100 ppm. CO
0.05–100 ppm. $SO_2$
0.05–100 ppm. NO
0.05–100 ppm. $NO_2$
0.05–100 ppm. $H_2S$
0.05–100 ppm. COS
0.05–100 ppm. $CH_3SH$
0.05–100 ppm. $CS_2$ the balance selected from the class of nitrogen or synthetic air.

* * * * *